US005656996A

United States Patent [19]

Houser

[11] Patent Number: 5,656,996

[45] Date of Patent: Aug. 12, 1997

[54] ELECTRONIC SECURITY BONDING DEVICE

[75] Inventor: Peter Bennett Houser, Poway, Calif.

[73] Assignee: Global Associates, Ltd., Falls Church, Va.

[21] Appl. No.: 613,945

[22] Filed: Mar. 13, 1996

[51] Int. Cl.[6] ..... G08B 13/06

[52] U.S. Cl. ..... 340/541; 340/539; 340/568; 340/652; 340/825.06

[58] Field of Search ..... 340/571, 568, 340/539, 540, 541, 542, 652, 825.06

[56] References Cited

U.S. PATENT DOCUMENTS

| | | | |
|---|---|---|---|
| 3,639,897 | 2/1972 | Teich | 340/426 |
| 3,656,100 | 4/1972 | Beltrami | 340/426 |
| 3,688,256 | 8/1972 | D'Ausilio et al. | 340/426 |
| 3,848,243 | 11/1974 | Schirmer | 340/545 |
| 3,961,323 | 6/1976 | Hartkorn | 340/426 |
| 4,627,248 | 12/1986 | Haworth | 70/134 |
| 4,688,244 | 8/1987 | Hannon et al. | 379/58 |
| 4,750,197 | 6/1988 | Denekamp et al. | 379/58 |
| 4,768,816 | 9/1988 | Bakula | 292/218 |
| 4,811,578 | 3/1989 | Masoncup et al. | 340/542 |
| 4,811,977 | 3/1989 | Swift et al. | 292/307 A |
| 4,816,803 | 3/1989 | Brown | 340/426 |
| 4,877,276 | 10/1989 | Pastva | 292/218 |
| 4,883,295 | 11/1989 | Kesselman | 292/307 R |
| 4,920,334 | 4/1990 | De Volai | 340/568 |
| 4,946,210 | 8/1990 | Fuehrer | 292/318 |
| 4,990,890 | 2/1991 | Newby | 340/539 |
| 4,996,909 | 3/1991 | Vache et al. | 454/184 |
| 5,005,883 | 4/1991 | Guiler | 292/327 |
| 5,025,253 | 6/1991 | DiLullo et al. | 340/825.06 |
| 5,050,794 | 9/1991 | Wischusen, III | 229/125.26 |
| 5,056,837 | 10/1991 | Fuehrer | 292/307 R |
| 5,120,097 | 6/1992 | Fattori et al. | 292/318 |
| 5,125,700 | 6/1992 | Fattori et al. | 292/318 |
| 5,127,687 | 7/1992 | Guiler | 292/327 |
| 5,189,396 | 2/1993 | Stobbe | 340/541 |
| 5,247,564 | 9/1993 | Zicker | 379/40 |
| 5,284,036 | 2/1994 | Rosenbaum | 70/14 |
| 5,443,190 | 8/1995 | Cucheran et al. | 224/405 |

*Primary Examiner*—Glen Swann
*Attorney, Agent, or Firm*—Banner & Witcoff, Ltd.

[57] ABSTRACT

An electronic bonding device provides a seal for containers and equipment and allows the status of the seal to be remotely monitored. The device has a seal body housing sensing means and communication means, and sealing means for affixing the device to an item to be bonded. The sealing means comprises a line providing, between terminal end portions, a circuit having a detectible characteristic. In one embodiment, the circuit is an optical fiber light transmission circuit. Alternatively, the circuit may be an electrical circuit. A change in the circuit characteristic, e.g., a break in the continuity (optical or electrical), is sensed by the sensor and transmitted to a remote location by a transmitter, to indicate that tampering with the item has occurred. The line is provided with a protective sheath. In one embodiment, the sheath is a relatively flexible adhesive tape strip. In other embodiments, the sheath is a relatively rigid or flexible shackle member.

21 Claims, 2 Drawing Sheets

ELECTRONIC SECURITY BONDING DEVICE

BACKGROUND OF THE INVENTION

The present invention relates to devices used to maintain and monitor the integrity of sealed containers and devices. More specifically, the invention relates to electronic tamper detection devices.

In commerce, there are a myriad of situations requiting the integrity of a sealed container to be maintained and monitored. For example, utilities equipment located in publicly accessible areas (e.g. electric power meters and cable TV hookups) is typically sealed in containers with a clasp having a crimped lead seal. Any tampering with the equipment can be detected by a break or removal of the original seal. Another example is provided by electronics equipment that may use a paper seal across screws or other components of the exterior case to prevent undetected entry and possible modification of the circuitry. As yet another example, pallets of individual items may be wrapped in plastic sheeting and secured with a specially marked or formulated adhesive strip which prevents disassembly of the pallet without visible damage to the sealing strip.

In an effort to improve upon the simple lead crimp-type seal mentioned above, numerous other shackle-type sealing devices have been developed for sealing and allowing detection of tampering with containers. See, e.g., U.S. Pat. Nos. 5,127,687 (Guiler); 5,056,837 (Fuehrer); 5,005;883 (Guiler); 4,946,210 (Fuehrer) 4,883,295 (Kesselman); 4,811,977 (Swift et al.). In addition to utilities equipment box applications, such devices are described as suitable for use, alone or in conjunction with separate heavy-duty locking means (e.g., a padlock), to secure cargo containers (e.g., semi-tractor trailers, railway cars and the like), and to prevent and detect tampering with mechanical/electrical devices such as railway and high-voltage switches.

The practice of sealing goods and equipment used in commerce, to ensure that they have not been opened, altered, removed or otherwise tampered with, will be referred to as "bonding." All of the aforementioned bonding arrangements require a visual inspection of a device to determine whether a seal violation has occurred. Such arrangements are less than ideal for certain applications in that they do not allow for such detection from a distance (i.e., remote detection). Instead of relying solely on a visual inspection, U.S. Pat. No. 5,120,097 (Fattori et at.) discloses a shackle-type seal incorporating a conductive strip and contact points that allow a manual check of electrical continuity as evidence of tampering. This sealing arrangement likewise requires an individual up-close check to see whether the seal has remained intact.

The ability to remotely electronically monitor the status of a plurality of seals would significantly reduce the time and effort required to perform individual checks. For example, within a warehouse there may be a great many items which have been sealed, and it may be necessary or deskable to periodically verify that the seals within the warehouse are all intact. To do so would conventionally require one or more persons to travel throughout the warehouse to individually inspect and record the status of each seal. Such manual checking is not only time and labor intensive, but is also prone to human error. On the other hand, remote electronic monitoring of seals would allow complete automation of the task by computer, thereby substantially reducing human labor and error.

Another situation wherein remote sensing would be highly useful arises in connection with trucks used to convey one or more bonded items, e.g., containers, or wrapped (bonded) pallets of individual items. At various times during transit it may be necessary or desirable to verify the seal(s), such as when the track leaves the point of origin, or when it passes through an international border. In such cases, it would be advantageous to have a means for verifying the seal(s) which does not require that the truck stop for inspection.

The need for alternative methods of bonding is becoming more acute as electronic transactions become more and more prevalent. For example, many governments are examining methods of arranging for goods to cross their borders whereby all customs and other information is passed electronically.

U.S. Pat. No. 4,750,197 (Dennekamp et al.) discloses a system for remotely monitoring cargo trip data. The system includes door mounted magnetic sensors for sensing the opening of a large freight container, e.g., a semi-truck trailer, and a cellular telephone for transmitting trip information, including signals from the door sensors, to a central processing facility.

U.S. Pat. No. 5,025,253 (DiLullo et al.) discloses a system for remotely checking the connect/disconnect status of a semi-tractor trailer. A cab mounted interface unit (IFU) is connected with an electronic tag (identifier) located on the trailer, through the truck's 12 volt power bus. When the trailer is disconnected, the IFU senses the absence of the electronic tag, and this result is transmitted to a central station via an on-board satellite transmitter.

The above two systems may be useful for monitoring whether a truck trailer or the like has been disconnected or opened, but both form an integral part of the vehicle. Thus, neither is suitable for direct application to an outside of multiple individual items, e.g., the cargo within a trailer, to thereby individually bond the items.

SUMMARY OF THE INVENTION

In view of the foregoing, it is a principal object of the present invention to provide bonding devices allowing remote electronic monitoring of the status of a seal, and which may be directly applied to an outside of individual items to be bonded.

It is a more specific object of the invention to provide bonding device configurations which are readily adaptable for sealing a variety of containers, packages and equipment, and which will not require any permanent or costly modifications to the items to be bonded.

It is another object of the invention to provide bonding devices which are tamper resistant and which render difficult, if not impossible, an undetectable restoration of a broken seal.

These and other objects are realized in accordance with the present invention by a bonding device which provides a seal and allows remote electronic monitoring of the seal. The device includes sealing means for affixing the device to an item to be bonded, in a manner such that tampering with the item will disturb the sealing means. The sealing means includes line means providing a circuit having first and second end terminals. The circuit exhibits a detectible circuit characteristic. Sensing means are connectible to the first and second end terminals. The sensing means produces a signal indicating a disconnection of the sensing means from the first and second end terminals, and a change in the detectible circuit characteristic, indicating tampering with the affixing means. Communicating means are provided for transmitting the signal to a location remote from the bonding device. A seal body is engageable with the sealing means and supportable thereby. The seal body houses the sensing means and communicating means as a unit.

These and other objects, features and advantages of the invention will be apparent and fully understood from the following detailed description of the preferred embodiments, taken in connection with the appended drawings.

DETAILED DESCRIPTION OF THE PREFERRED EMBODIMENTS

Figure 1:
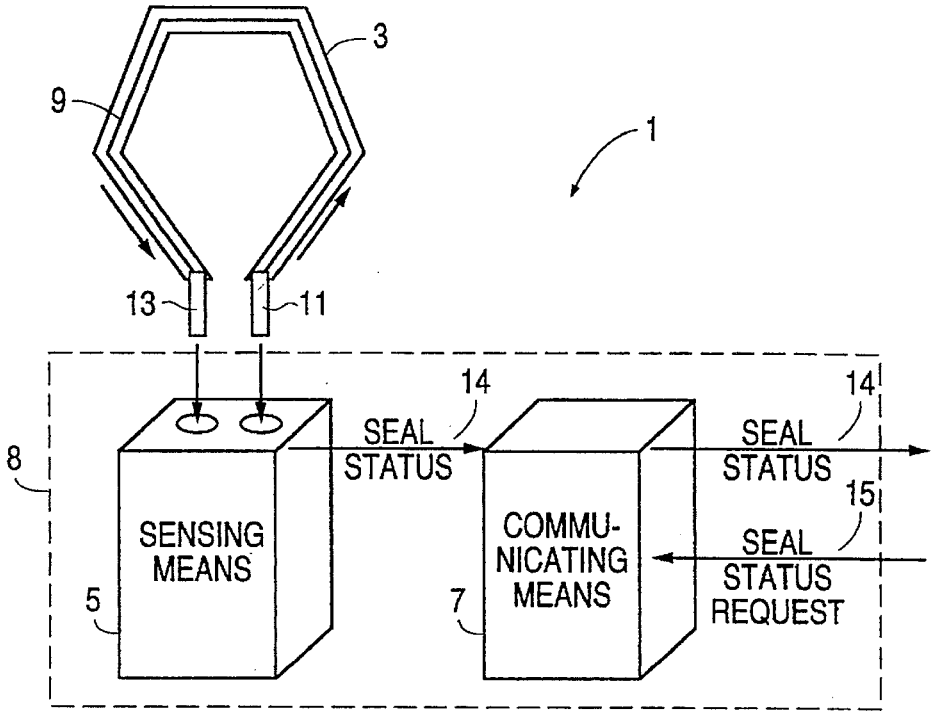
FIG. 1 is a diagrammatic depiction of the primary functional elements of a bonding device in accordance with the present invention.

Referring first to FIG. 1, a bonding device 1 in accordance with the present invention has as its principal components sealing means 3, sensing means 5 and communicating means 7. Sealing means 5 and communicating means 7 are housed together as a unit in a seal body 8 which is engageable with sealing means 3. ("Engageable" is used broadly to refer to both an existing engagement and an ability to become engaged, either permanently or releasably.) Sealing means 3 serves as a structural member that can be affixed to an outside of an item to be bonded in such a manner that an attempt to open or otherwise tamper with the item will disturb the sealing means. Sealing means 3 also serves to support (on the item) body 8 such that no separate mounting or securement of the seal body is necessary.

Sealing means 3 also incorporates line means forming a circuit exhibiting a detectible circuit characteristic between first and second end terminals 11, 13. Attempts to open or otherwise tamper with the item will disturb sealing means 3 and cause an alteration of the circuit characteristic. Such a change will be sensed by sensing means 5, and a signal indicating the same will be transmitted to a remote monitoring location by communicating means 7.

In the presently preferred embodiment, the line means consists of a single line 9 extending between end terminals 11, 13. Line 9 may be an optical fiber establishing a path of optical continuity, or an electrical conductor, e.g., a wire, establishing a path of electrical continuity. With a simple single line arrangement, the detectible circuit characteristic may simply be the existence of continuity (electrical or optical). A break in continuity will be sensed by sensing means 5. Sensing means 5 will generate a corresponding seal status signal 14 and the signal will be transmitted to a remote monitoring location by communicating means 7, to indicate the occurrence of tampering. Likewise, a disconnection of end terminals 11, 13 from sensing means 5 will cause sensing means 5 to produce a signal indicating an occurrence of tampering.

For some applications, it may be desirable to provide a more complex line arrangement. For example, if an entire pallet of items is to be bonded as a single unit, it may be desirable to provide line means in the form of a web or net structure encompassing the pallet and forming an electrical circuit with a plurality of parallel and series branches. The branches could comprise resistive, capacitive or inductive elements serving to establish one or more detectible overall circuit characteristics, e.g., impedance, capacitance, or inductance. In such an arrangement, a break in one or more of the branches would result in a change in one or more of the circuit characteristics (instead of a complete loss of continuity). Such a change would be sensed by sensing means 5 and a corresponding signal would be transmitted to the remote sensing location by communicating means 7.

As another example, multiple electrical wires or fiber optic threads could be imbedded in an adhesive tape or other sheath structure and be individually monitored by the sensing means. This would increase the difficulty of "jumpering around" the seal, since each line would have to be individually bypassed.

Sensing means 5 may take a variety of forms. In its simplest form, the sensing means will operate by transmitting energy through line 9 and detecting the energy return through the loop. The transmitted energy could be electrical, optical, or some other form, depending on the nature of the circuit formed in sealing means 3.

The energy can be continuously transmitted, intermittently transmitted, or transmitted only upon receipt by the communicating means of a seal status request 15 from an external system, e.g., the remote monitoring system, that the seal be verified. Continuous energy transmission affords the most security since it will not allow someone to disturb and then repair the circuit prior to seal verification.

Sensing means 5 produces a signal indicative of the status of sealing means 3 (including whether one of the terminal end portions has been detached from the sensing means) and supplies the signal to communicating means 7. The signal may be analog, e.g., a measure of the impedance of line 9, or an analog to digital (A/D) convened signal.

Communicating means 7 may be selected based upon the physical constraints involved in accessing the seal. A low-power radio frequency transponder is an inexpensive technique appropriate to checking seal integrity over a distance of a few hundred feet to several thousand feet. For example, radio frequency transponders manufactured by Hughes/Delco of Fullerton, CA and Mark IV of Toronto, Canada, for roadside to vehicle communications, could be adapted for use in device 1.

Hughes/Delco manufactures a transponder, known as the "PrePass" transponder, for the PrePass and I-75 commercial vehicle weight and credentials programs. Its dimensions are about 2"×2"×1.5". It has an RS-232 serial interface that could be used to receive a digital seal status signal from the sensing means, a 512 bit internal memory which could be written into when the sensing means is polled, and a range of several thousand feet. The device is designed to operate with an external power source, e.g., the power source of a vehicle.

Mark IV provides transponders generally comparable to the Hughes/Delco transponders. The Mark IV transponders can be read using in-the-mad loop antennas, whereas the Hughes/Delco transponders are read with above-ground antennas.

PAR Corporation of Alexandria, VA has manufactured for the Federal Highway Administration (FHWA) a transponder used to track hazardous material containers on board trucks or in warehouses. The transponder is roughly about the size of a quarter, including electronics, battery and antenna, and thus is well suited for use in a compact seal body in accordance with the present invention. It has a 1000' range, 10 year battery shelf life, and a two year operating battery.

A wide variety of alternative communications schemes are envisioned, including but not limited to the following:

(1) When installed on a vehicle, or cargo therein, seal status information (digital or analog) can be transmitted over the vehicle's power distribution network to other on-vehicle systems. In this instance, each bonding device could be suitably wired to the vehicle's power distribution network via a quick-connect/disconnect junction box or the like.

(2) The communicating means could be directly wired to another system (vehicle or otherwise). For example, a digital signal transmission could be provided to a personal computer via an RS-232 serial port or the like. In a vehicle application, the additional system could be a Hughes/Delco or Mark IV radio frequency transponder used to provide vehicle to roadside communication of seal status information.

(3) The transmission means may be connected with a local area network (LAND allowing it to communicate digital signal information to computers and other devices connected to the LAN. A wide variety of LANs could potentially be used. Examples include Ethernet and CEBus, as well as LANs being developed especially for vehicles.

(4) The communicating means may communicate digital signal information over telephony and emerging personal communications systems, including terrestrial and satellite based cellular telephone systems. It is contemplated that the communicating means itself could be a portable cellular phone and modem, or the communicating means could be connected to an external cellular phone and modem. Cellular phone modems are available "off-the shelf" from Motorola. Bell South of Atlanta, Ga. is now offering a product called Cellemetry, which passes small data packets over cellular lines. The transmitting electronics board is about 3" by 1.5" and requires little power, making it potentially well suited for use as an internal communicating means.

The sensing means and communicating means will generally each require a source of electric power. In the case of (1) above, power for both of the components could be provided by the vehicle's power distribution network. Alternatively, power could be provided by batteries within the device, or via wiring to another external source. In any event, it is preferred that the sensing means be capable of sensing a loss of power and producing a corresponding signal. Such a signal could be the same as, or differentiated from, the signal produced on detection of a break in sealing means 3. The signal could be generated and stored at a time just prior to complete power loss, when sufficient power is remaining to perform these functions. A visual signal or other means for local detection of the power loss condition could be provided and/or the signal could be transmitted to a monitoring station immediately upon restoration of power.

Sensing means 5 could produce a real time signal indicating a seal status. With such an arrangement, the signal could be processed externally, e.g., by a computer, to create an alarm condition and/or to make a record of the time and date of any seal violation. Preferably, however, some data processing and storage will occur internally, e.g., by signal processing and storage means included within the sensing means and/or the communicating means blocks. Preferably, the sensing means will permanently record (e.g. in non-violatile memory) any break in the seal, and transmission of this result will occur when the seal is "polled" by a remote reader. In addition, the sealing means could be operative to record the time and date of a seal violation or power loss, for later transmission by the communicating means.

Figure 2:
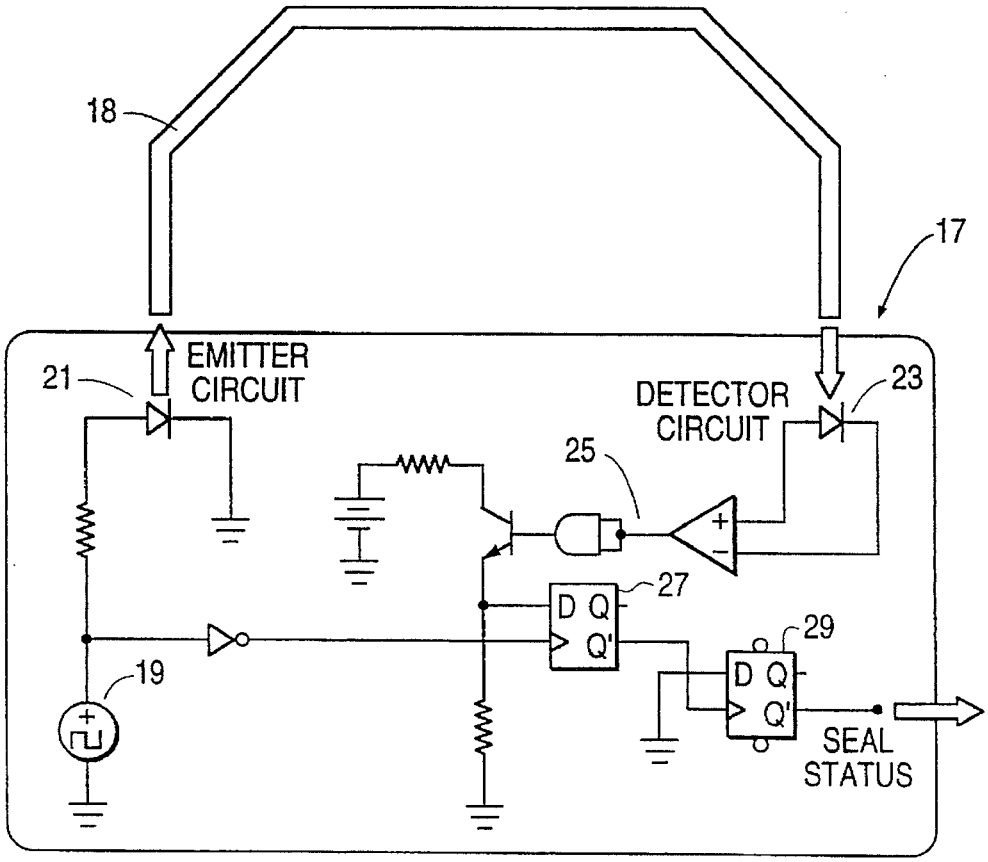
FIG. 2 is a schematic diagram illustrating an exemplary sensing circuit in accordance with the present invention.

An exemplary sensing circuit 17 is illustrated in FIG. 2, wherein the line means comprises a fiber optic loop 18. An emitter circuit comprises a square wave generator 19, nominally 10 Hz, and an LED 21. LED 21 is optically coupled with an end of fiber optic loop 18. A detector circuit comprises a diode 23 optically coupled with an opposite end of loop 18. A Schmidt trigger 25 is provided to sharpen edges and provide hysteresis. A bistable multivibrator (D flip-flop) 27, compares the square wave source to the received signal and provides a low signal if the circuit is intact. A latch 29 will provide a low output so long as the circuit remains intact. The output of the latch will remain high if the circuit is ever broken. In this manner, the output of latch 29 provides a seal status signal that is provided to the communication means for transmission to a remote monitoring location.

Particular physical configurations of bonding device 5 will now be described. In large part, the most appropriate physical configuration will be depend on the bonding application, i.e., the nature of the container or other item to be bonded. Bonding device 5 can, on one hand, serve primarily as a signalling device, affording little to no physical impediment to opening or other tampering with the bonded item. In such cases, the bonding device may be used with other security devices that do afford physical protection. For example, if the item to be bonded is a container or piece of equipment designed to be locked with a padlock, two possibilities arise.

First, a standard padlock could be used along side a bonding device in accordance with the invention to provide both physical security and signalling of any seal violation. In such a case, the circuit forming sealing means 3 could take the form of an insulated but otherwise unprotected loop of wire or optical fiber that would be run parallel to the shackle of the padlock, through the lock receiving structure of the item to be bonded. The seal body could be made of a relatively lightweight low-strength material such as molded plastic. In this variation, an optical fiber circuit would be much more difficult to splice back together than wire (in an attempt to mask a violation of the seal).

Figure 3:
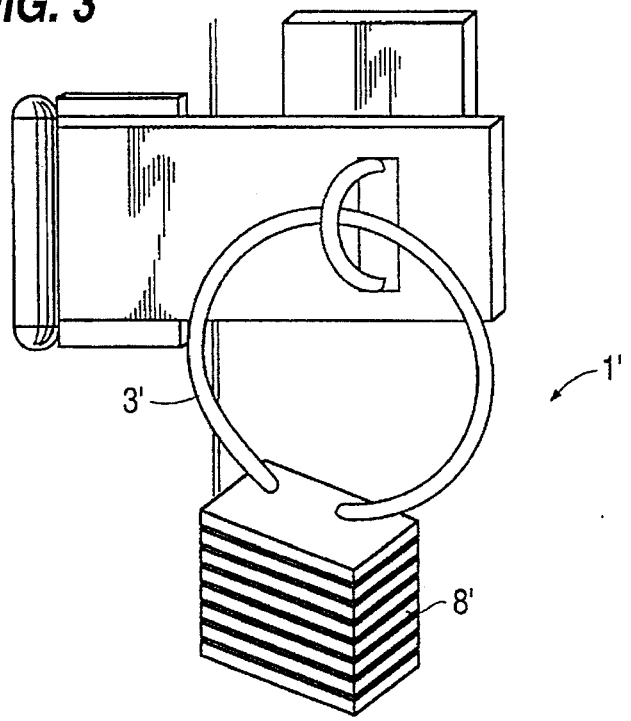
FIG. 3 is a perspective view of an application of one embodiment of the invention comprising a padlock-like structure.

A second option would be to provide the bonding device itself as a padlock-like structure 1', as shown in FIG. 3, in order to provide both security and tamper protection. In this embodiment, seal body 8' comprises a heavy armor of hardened steel plates or the like, for housing the sensing means, communicating means, and, possibly, a battery. The transmit antenna for transponders such as the PAR device can be very small. For example, the antenna could comprise a simple "patch" mounted on the exterior of the armored lock body. Despite the fact that the antenna would be susceptible to damage by tampering or otherwise, the seal itself would be quite secure. In some applications, it will be desirable to have the remote sensing station set up to detect and generate a signal indicating a loss of signal transmission. In this manner, an attendant will be alerted to the possibility of antenna damage or other malfunction, or removal of the bonded item from the monitoring area.

The sealing means 3' forms a high strength shackle member comprising a circuit defining line (not visible)

encased by a sheath of high strength material. The sheath could be relatively rigid, formed of hardened steel or the like, or relatively flexible, formed of steel cabling or Kevlar fibers. The length and configuration of sealing means 3' can obviously be varied to suit the needs of the particular application.

Figure 4:
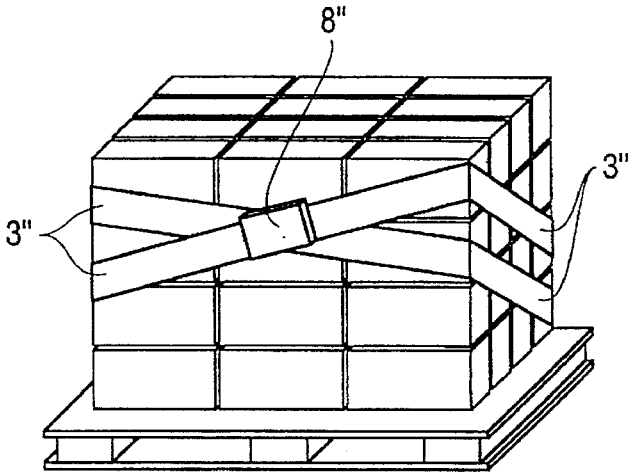
FIG. 4 is a perspective view of an application of a second embodiment of the invention including affixing means in the form of an adhesive tape strip.

In a further embodiment, the sealing means 3" is provided in the form of one or more circuit defining lines (multiple lines shown in FIG. 5) encased (sheathed) by a relatively flexible adhesive tape strip. The ends of the tape strip are connected with sensing and communicating means housed as a unit within seal body 8". This embodiment is particularly well suited for sealing cartons and/or pallet-loads of individual items, as seen in FIG. 4.

Figure 5:
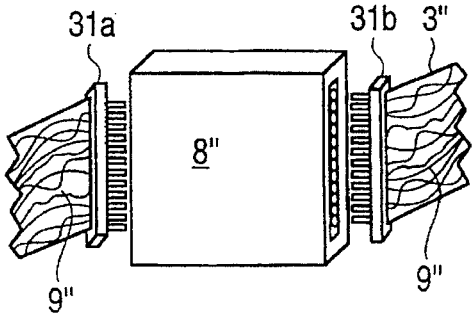
FIG. 5 is a close-up partial perspective view of an adhesive tape strip embodiment of the type shown in FIG. 4.

The tape could be provided in standard lengths, with the circuit defining line(s) pre-terminated at each end with suitable connectors 31*a,b*. Alternatively, the tape could be provided on rolls, and a tool provided for affixing connectors to the ends of a piece of tape which has been cut to length. The tape could be reinforced with fiberglass, Kevlar or other fiber materials. This would not only lend additional packaging strength but would render more difficult attempts to locate and splice lines 9" (in an effort to cover-up a seal violation), particularly if line 9" is provided as an optical fiber. Security can also be enhanced by using multiple lines 9", and randomly directing the extending directions of lines 9", as seen in FIG. 5.

The present invention has been described in terms of presently preferred embodiments thereof. Numerous other embodiments, modifications and features within the scope and spirit of the appended claims will occur or persons having ordinary skill in the art from a review of this disclosure.

I claim:

1. A bonding device for providing a seal and allowing remote electronic monitoring of the seal, comprising:

sealing means for affixing said device to an item to be bonded, in a manner such that tampering with the item will disturb the sealing means, said sealing means comprising line means providing a circuit having first and second end terminals, said circuit exhibiting a detectible circuit characteristic;

sensing means connectible to the first and second end terminals, said sensing means producing a signal indicating a disconnection of the sensing means from the first and second end terminals, and a change in said detectible circuit characteristic, indicating tampering with said sealing means;

communicating means for transmitting said signal to a location remote from said bonding device; and a seal body engageable with said sealing means and supportable thereby, said seal body housing said sensing means and communicating means as a unit.

2. A bonding device according to claim 1, wherein said circuit comprises an optical fiber light transmission circuit.

3. A bonding device according to claim 2, wherein said circuit characteristic comprises optical continuity between said first and second end terminals, and said change in the circuit characteristic comprises a loss of optical continuity.

4. A bonding device according to claim 1, wherein said circuit comprises an electrical circuit.

5. A bonding device according to claim 4, wherein said circuit characteristic comprises impedance, and said change in the circuit characteristic comprises a change in impedance.

6. A bonding device according to claim 5, wherein said circuit characteristic comprises electrical continuity, and said change in the circuit characteristic comprises a loss of electrical continuity.

7. A bonding device according to claim 1, wherein said line means consists of a single line extending between said first and second end terminals.

8. A bonding device according to claim 1, wherein said line means comprises a plurality of lines extending between said first and second end terminals.

9. A bonding device according to claim 1, wherein said line means is encased in a protective outer sheath.

10. A bonding device according to claim 9, wherein said outer sheath is a relatively flexible sheath.

11. A bonding device according to claim 10, wherein said relatively flexible sheath comprises Kevlar fiber.

12. A bonding device according to claim 9, wherein said outer sheath comprises a relatively rigid shackle member.

13. A bonding device according to claim 9, wherein said sheath comprises a relatively flexible adhesive tape strip.

14. A bonding device according to claim 1, wherein said communicating means comprises a radio frequency transponder.

15. A bonding device according to claim 1, further comprising an electrical power source housed within said seal body.

16. A bonding device according to claim 15, wherein said power source comprises a battery.

17. A bonding device according to claim 1, wherein said sensing means operates continuously.

18. A bonding device according to claim 1, wherein said sensing means operates intermittently.

19. A bonding device according to claim 1, wherein said sensing means operates in response to a seal status request received by the communicating means.

20. A bonding device according to claim 1, further comprising signal processing and data storage means within said seal body, said signal processing means for receiving signals from said sensing means and producing data concerning the same, said storage means for storing said data.

21. A bonding device according to claim 20, wherein said communicating means transmits said data in response to an externally generated seal status inquiry.

* * * * *

US005656996C1

(12) EX PARTE REEXAMINATION CERTIFICATE (6513th)

United States Patent

Houser

(10) Number: US 5,656,996 C1

(45) Certificate Issued: Nov. 11, 2008

(54) ELECTRONIC SECURITY BONDING DEVICE

(75) Inventor: Peter Bennett Houser, Poway, CA (US)

(73) Assignee: Blank Rome Comisky & McCauley LLP, Washington, DC (US)

Reexamination Request:
No. 90/006,896, Dec. 24, 2003

Reexamination Certificate for:

| | |
|---|---|
| Patent No.: | **5,656,996** |
| Issued: | **Aug. 12, 1997** |
| Appl. No.: | **08/613,945** |
| Filed: | **Mar. 13, 1996** |

(51) Int. Cl.
*G08B 13/14* (2006.01)

(52) U.S. Cl. ..... 340/541; 340/539.1; 340/539.31; 340/568.1; 340/652

(58) Field of Classification Search ..... None
See application file for complete search history.

(56) References Cited

U.S. PATENT DOCUMENTS

| | | | | | |
|---|---|---|---|---|---|
| 3,714,644 | A | * | 1/1973 | Hellstrom | 340/508 |
| 3,820,073 | A | * | 6/1974 | Vercellotti et al. | 340/870.03 |
| 3,938,124 | A | * | 2/1976 | Way et al. | 340/531 |
| 4,233,595 | A | | 11/1980 | Landkammer | 340/542 |
| 4,262,284 | A | * | 4/1981 | Stieff et al. | 340/541 |
| 4,290,056 | A | * | 9/1981 | Chow | 340/538 |
| 4,447,123 | A | * | 5/1984 | Page et al. | 385/115 |
| 4,755,792 | A | * | 7/1988 | Pezzolo et al. | 340/538 |
| 4,804,957 | A | * | 2/1989 | Selph et al. | 340/870.03 |
| 5,001,755 | A | * | 3/1991 | Skret | 380/46 |
| 5,097,253 | A | * | 3/1992 | Eschbach et al. | 340/545.1 |
| 5,239,459 | A | * | 8/1993 | Hunt et al. | 700/90 |
| 5,656,996 | A | | 8/1997 | Houser | 340/541 |
| 5,686,902 | A | * | 11/1997 | Reis et al. | 340/10.2 |
| 5,689,243 | A | * | 11/1997 | Bianco | 340/5.26 |

OTHER PUBLICATIONS

Shih–Lien L. Lu, Random Access Memory, Memory Architecture, Wiley Encyclopedia of Electrical and Electronics Engineering, DOI 10.1002/047134608X.W1660, Dec. 27, 1999, Section 4.2., retrieved from the Wiley Interscience database, URL: http://www.mrw.interscience.wiley.com/ on Apr. 27, 2007.*

* cited by examiner

*Primary Examiner*—Roland G. Foster

(57) ABSTRACT

An electronic bonding device provides a seal for containers and equipment and allows the status of the seal to be remotely monitored. The device has a seal body housing sensing means and communication means, and sealing means for affixing the device to an item to be bonded. The sealing means comprises a line providing, between terminal end portions, a circuit having a detectible characteristic. In one embodiment, the circuit is an optical fiber light transmission circuit. Alternatively, the circuit may be an electrical circuit. A change in the circuit characteristic, e.g., a break in the continuity (optical or electrical), is sensed by the sensor and transmitted to a remote location by a transmitter, to indicate that tampering with the item has occurred. The line is provided with a protective sheath. In one embodiment, the sheath is a relatively flexible adhesive tape strip. In other embodiments, the sheath is a relatively rigid or flexible shackle member.

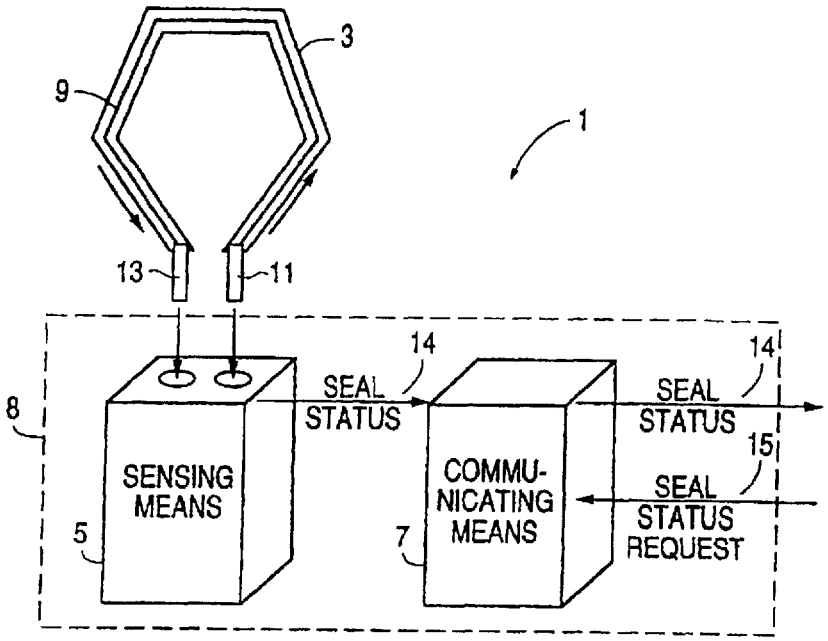

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–21 are cancelled.

* * * * *